United States Patent [19]

Batchelder

[11] 4,270,722

[45] Jun. 2, 1981

[54] FIRE EXTINGUISHER HOLDER

[76] Inventor: Leonard E. Batchelder, 21111 22 Mile Rd., Mount Clemens, Mich. 48044

[21] Appl. No.: 888,012

[22] Filed: Mar. 20, 1978

[51] Int. Cl.[3] ..... A47F 5/00

[52] U.S. Cl. ..... 248/310; 211/71; 248/311.2

[58] Field of Search ..... 248/309, 310, 311.1, 248/229, 230, 219.4, 316 R, 314, 313; 211/91, 88, 75; 169/51

[56] References Cited

U.S. PATENT DOCUMENTS

| | | | |
|---|---|---|---|
| 1,345,252 | 6/1920 | Rubin | 248/311.1 X |
| 1,437,303 | 11/1922 | Hatch | 248/310 X |
| 1,671,747 | 5/1928 | Seeger | 248/219.4 X |
| 2,549,680 | 4/1951 | Fowle | 248/311.1 |
| 2,942,366 | 6/1960 | Pfaff et al. | 248/230 UX |
| 3,229,947 | 1/1966 | White | 248/314 |
| 3,463,436 | 8/1969 | Foster | 211/71 X |
| 3,921,949 | 11/1975 | Coon | 248/219.4 X |

FOREIGN PATENT DOCUMENTS

| | | | |
|---|---|---|---|
| 93725 | 12/1938 | Sweden | 248/219.4 |

*Primary Examiner*—J. Franklin Foss

*Attorney, Agent, or Firm*—Burton, Parker & Schramm

[57] ABSTRACT

A fire extinguisher holder for holding a fire extinguisher adjacent a support having a cylindrical container open at each end for receiving the fire extinguisher therein and having inner and outer wall surfaces, said outer wall surface being secured to a mounting means such as a pair of straps for retaining the container adjacent the support despite abutment by environmental objects and having supporting means secured to the base of the container for retaining the fire extinguisher therein.

4 Claims, 13 Drawing Figures

FIRE EXTINGUISHER HOLDER

FIELD OF INVENTION

The invention relates generally to the field of supporting holders and, more particularly, to fire extinguisher holders.

PRIOR ART STATEMENT

The following patents are representative of the prior art in supporting holders, U.S. Pat. Nos.: 1,015,183; 1,314,186; 1,360,829; 3,105,594; 3,131,900; 3,184,201; 3,229,947; 3,790,118; 3,964,708; 4,036,463; 4,037,814.

In general, the above-cited patents disclose holders which are secured to a wall or support by bolts, welds or the like which are now considered unsafe by people familiar with the art because of increased stress applied by such securing means to the I-beam support. Another characteristic of the holder disclosed in the patents are their inflexible support positions and lack of protective housings. For example, U.S. Pat. Nos. 1,314,186, 1,360,829 and 4,037,814 show fire extinguisher holders, each representing a different construction for releasing the extinguisher from its holder. None of the holders, however, protect the fire extinguishers from being abutted by environmental objects which could crease the sides of the fire extinguisher, particularly because the thickness of the sides of the fire extinguisher are in the 1/32" range. Once the surface of a fire extinguisher is creased, it must be removed as defective. Moreover, none of the fire extinguisher patents show releasable adjustable attachment to an I-beam support. The fire extinguisher patents also show extinguishers fixedly supported by the holder, not loosely supported for rapid removal. U.S. Pat. Nos. -900 and -463 show releasable support of a paint holder to a ladder. The paint cans are retained in an upright condition by the paint holder which is pivoted to the supporting means in an overcenter relationship. It is apparent that the holder is not cylindrical nor desirable for holding fire extinguishers loosably therein since abutment by environmental objects could spill the contents of the holder should the holder be sufficiently rotated about the pivot by the object.

SUMMARY OF INVENTION

According to the invention there is provided a fire extinguisher holder for holding a fire extinguisher adjacent a support comprising a cylindrical container open at each end, one end receiving a fire extinguisher therein, and the other end having supporting means integrally secured adjacent the base of the container and mounting means secured to the outer wall surface of the container for releasably retaining the container to a support. The holder is so constructed that abutments from objects traveling through the plane occupied by the holder do not damage the holder nor release the holder from its supporting position.

An alternative embodiment shows a container having an annular lip secured to the top of the said container for preventing inadvertent injury to operators or equipment from the container's exposed upper edge.

In another alternative embodiment, the container has supporting means comprising longitudinal members integrally secured to the walls of the container substantially adjacent the base of the container and intersecting substantially midway the length of the members. Another embodiment of the supporting means shows a base integrally secured to the walls of the cylinder and perforated by triangular openings for drainage of liquid or removal of debris therethrough.

Still, in another embodiment, the fire extinguisher holder is provided with a vertical opening within its wall extending downward from the top of the container. Another embodiment shows a holder with a similar opening within the wall of the container and a trough extending outward from the base of the opening for holding a vertical tube laterally outward from the container for insertion of a fire extinguisher hose therein.

Still other embodiments illustrate various types of mounting means for securing the container tightly against the support.

DESCRIPTION OF PREFERRED EMBODIMENT

Figure 11:
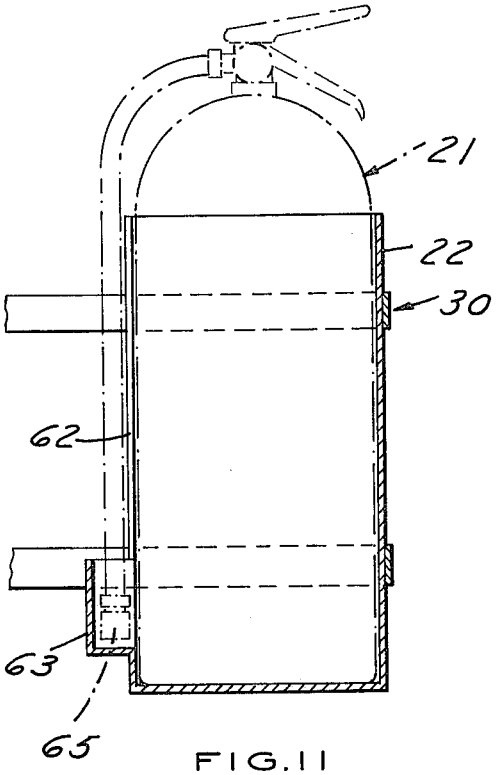
FIG. 11 is a fragmentary side view taken along lines 11—11 of FIG. 10 and showing a fire extinguisher in phantom.

In the drawings there is illustrated a holder, generally indicated at 20, for holding a fire extinguisher 21, shown in outline in FIG. 11, to a support or the like, such that environmental abutments cannot damage or move the holder from its supporting position. The holder 20 must be constructed such that physical abutments by immovable objects do not crease or damage the fire extinguisher, since most fire extinguishers are constructed with relatively thin walls, any crease placed in the surface of the extinguisher may dissipate the vacuum within the extinguisher because of the thin walls of the extinguisher. Generally, the holder 20 comprises a cylindrical container 22 having a length greater than its width and made of any impact resistant material such as steel, reinforced fiberglass, polyvinyl chloride, polyesters, aluminum, magnesium, iron, Lucite (trademark of Du Pont for acrylate resins), or the like. The cylindrical container 22 also has openings at the top and bottom for receiving the fire extinguisher therein and mounting means 24, which are secured to the outer wall surface 26 of the container 22 for releasably retaining the holder 20 adjacent the support.

Figure 1:
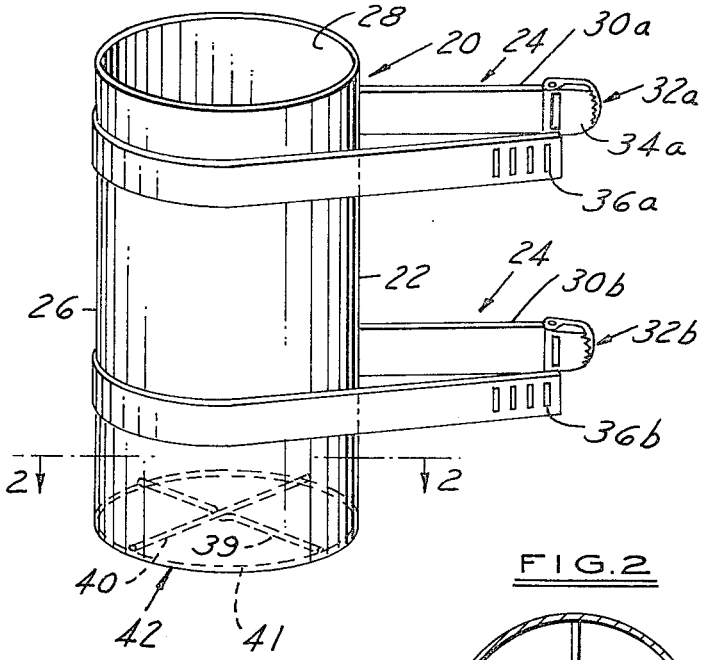
FIG. 1 is a perspective view of the fire extinguisher holder.

FIG. 1 is a perspective view of the fire extinguisher holder having a cylindrical container 22 with an inner wall surface 28 and an outer wall surface 26. Outer wall surface 26 secures mounting means 24 in a manner commonly known in the art, such as by pins, rivets, or an adhesive. Mounting means 24 comprises a pair of straps 30*a* and 30*b*, each secured substantially near the associated end of the container 22. Location of the straps substantially adjacent the associated ends of the container assists in retention of each end of the container tightly against the support.

Each strap of the mounting means terminates in either a receiving member or an engaging member of an alligator clip 32*a*, 32*b*. The receiving member 36*a*, 36*b* has a series of ratchets or holes such that a pawl on the engaging member 34*a*, 34*b* can be locked thereon. Accordingly, adjustments can be made in the length of the strap 32*a*, 32*b* by adjusting the ratchet or hole engaged by the pawl. The above described mounting means is necessitated by the current trend in industries refusing to fixedly, as by bolts, welds, or the like, secure fire extinguisher holders to an H or I-beam support. Nevertheless, the mounting means must retain the holder sufficiently secured against the support such that the holder is not loosened from its vertical position permitting the holder to fall to the floor when abutted by objects commonly found in a factory environment.

Figure 2:
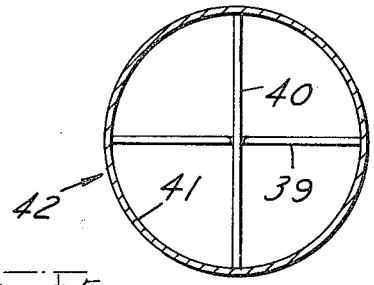
FIG. 2 is a fragmentary view of the base taken along lines 2—2 of FIG. 1.

Supporting means are provided which are integrally secured to the walls of the container and are located substantially adjacent the base of the container. FIGS. 1 and 2 show supporting means comprising a base 42 having two longitudinal members 39, 40 intersecting substantially midway the length of each member and forming a series of 90° openings in the base. Both longitudinal members are supported by an inner lip 41 extending inward from the inner wall surface of the container and can be either welded, glued or threaded at both ends for securing to the container. The longitudinal members form a support for the fire extinguisher within the holder 20, as well as assisting in the discharge of debris and the free flow of liquid which becomes entrapped within the container.

Figure 9:
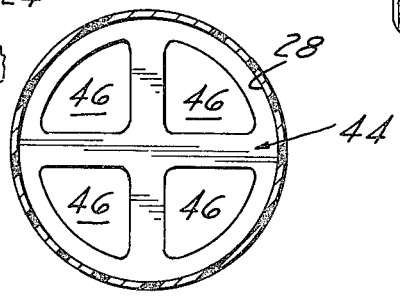
FIG. 9 is a fragmentary view of the base similar to FIG. 2.

FIG. 9 shows another embodiment of the supporting means wherein said means comprises a base 44 integrally secured to the inner wall surface 28 of the container in a manner commonly known in the art, such as molded to the walls of the cylinder, for supporting the fire extinguisher therein and having triangular openings 46, the apex of said triangular openings directed radially inward and the bottom of said triangular openings lying substantially adjacent the inner wall surface 28 of the container thus facilitating in the discharge of liquids or debris trapped within the container.

Figure 3:
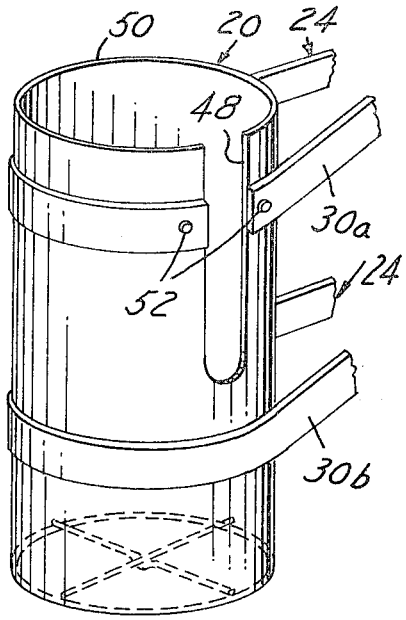
FIG. 3 is a view similar to FIG. 1 showing a vertical opening in the side of the container.

FIG. 3 shows a container 20 having a vertical opening 48 within the wall of the container extending downward from the upper edge 50 of the container and of sufficient width for permitting the hose of the fire extinguisher supported within the container to extend therethrough. The upper strap 30*a* is secured by bolts, rivets, or the like adjacent either side of the openings at 52 for retaining the straps in a condition for securing the container adjacent the support.

Figure 4:
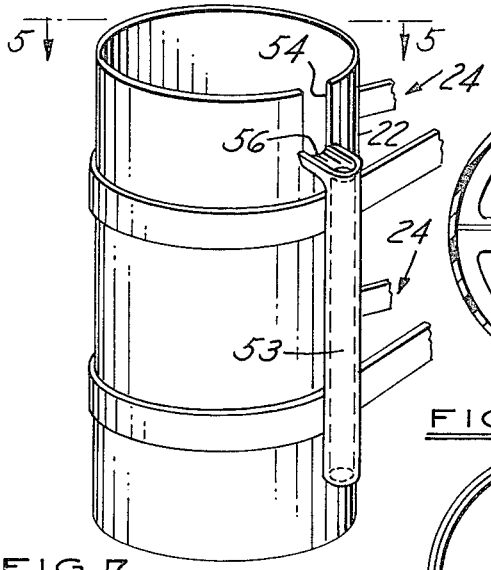
FIG. 4 is a view similar to FIG. 1 showing a vertical tube extending adjacent to the container.
Figure 5:
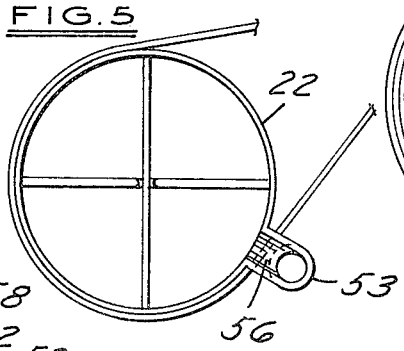
FIG. 5 is a fragmentary view of the container taken along lines 5—5 of FIG. 4.

Additional means can also be added to assist in supporting the fire extinguisher. For example, FIGS. 4 and 5 show a holder similar to the FIG. 3 embodiment, but having tubular means comprising a tube 53 extending downward from the base of an opening 54, the tube being secured outward from the container by a trough 56 which is integrally joined to tube 53 substantially near the top of the tube. The tube's inner diameter is of sufficient width to permit receipt of the fire extinguisher hose therethrough, and of sufficient length such that the nozzle on the end of the fire extinguisher hose is enclosed within the tube.

Figure 6:
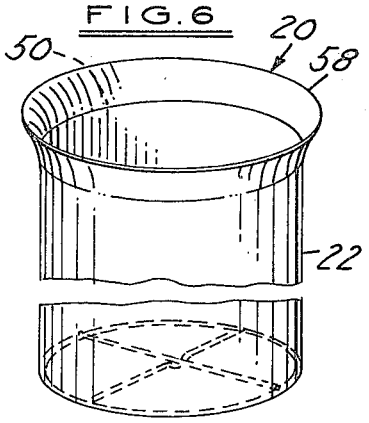
FIG. 6 is a fragmentary view of the container similar to FIG. 1 showing an annular lip.

FIG. 6 is a partial perspective view showing a container having an annular lip 58 extending upwardly and outwardly from the upper edge 50 of the container and providing a surface which protects equipment and operators from injury caused by the exposed upper edge 50 of the container 22.

Figure 8:
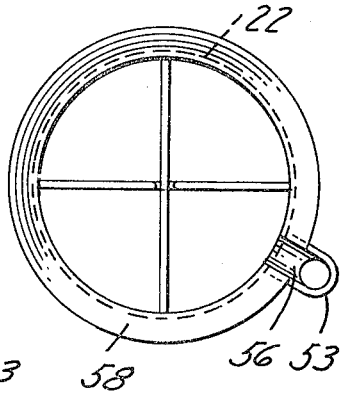
FIG. 8 is a fragmentary view of the container taken along lines 8—8 of FIG. 7.
Figure 7:
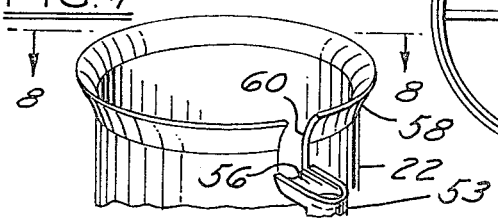
FIG. 7 is a fragmentary view of the container similar to FIG. 4 showing an annular lip with a vertical tube extending adjacent to the container.

FIGS. 7 and 8 show an embodiment of the container having the annular lip 58 and a tube 53 extending downward from the side of the container and having a construction similar to that previously described. Accordingly the opening 60 in the side of the container extends from the upper edge 50 upward through the annular lip 58 and downwardly to the trough 56, which is integrally secured to the tube 53, such that the hose of the fire extinguisher may lie integrally within the trough 56 and tube 53.

Figure 10:
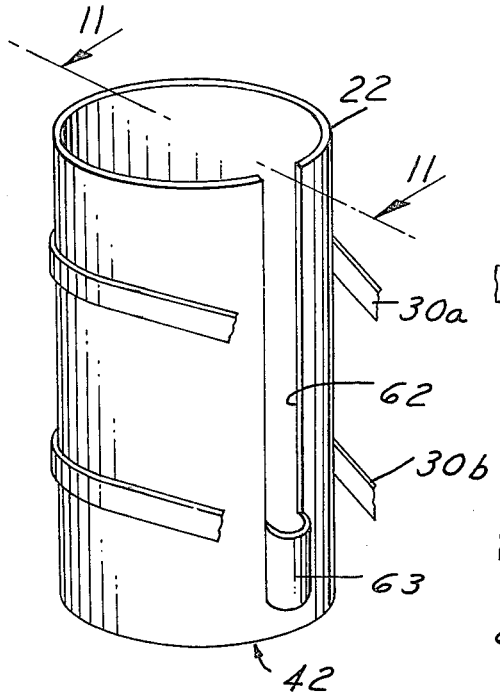
FIG. 10 is a view similar to FIG. 1 showing an alternative embodiment.

FIG. 10 illustrates a further embodiment of the container having an elongated opening 62 extending downwardly from the upper edge 50 of the container to substantially near the base 42 of the container. Integrally attached to the container and surrounding the base of the opening 62 is a semi-circular projection 63 extending outwardly from the opening and forming tubular means for receiving the end 65 of the fire extinguisher nozzle therein as best shown in FIG. 11. FIG. 10 also shows the placement of the straps of the container surrounding the container such that the straps 30*a*, 30*b* do not cross the opening 62.

Figure 12:
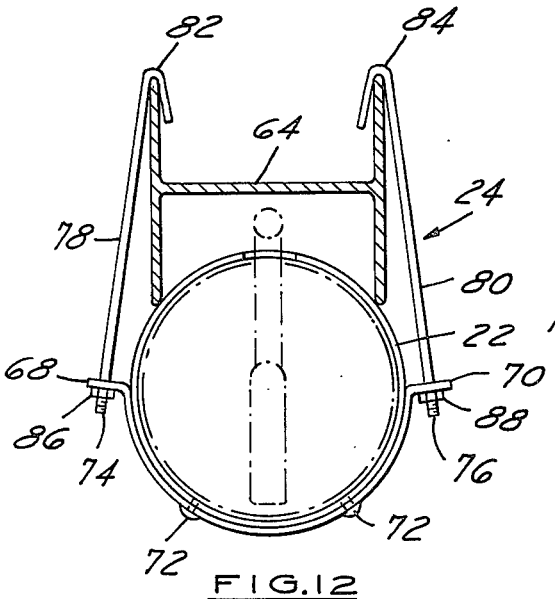
FIG. 12 is a top view of the container and a support.

FIG. 12 shows an alternative embodiment for mounting means 24 to secure the holder to a fixed support, such as an H or I-beam 64. Adjustable means are provided comprising a bracket 66 having depending tabs 68, 70, said tabs being secured to the container 22 by studs, bolts, or the like at 72. Each depending tab 68, 70 has a hole therethrough for receiving the screw threaded end 74, 76 of elongated bolts 78, 80. On the opposite end of each elongated bolt 78, 80 there is provided an engaging portion 82, 84 which is formed in the shape of a hook for engaging the opposite edges of the I-beam. Using this construction the nuts 86, 88 on the screw threaded portions 74, 76 of the elongated bolts 78, 80 can be tightened or untightened to adjust the tension of the container against the I-beam 64.

Figure 13:
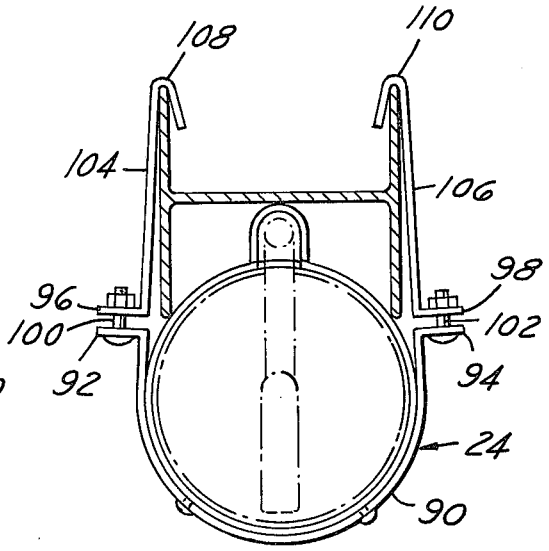
FIG. 13 is a view similar to FIG. 12.

FIG. 13 also shows an alternative embodiment for mounting means 24 to secure the container against an H or I-beam 64 wherein there is again provided adjustable means comprising a bracket 90 having depending tabs 92, 94 secured to container 22 in a similar manner. Secured to each depending tab 92, 94 are opposed depending tabs 96, 98 by bolt assemblies 100, 102. Each opposed depending tab 96, 98 is formed from an elongated rod 104, 106 having engaging portions 108, 110, the engaging portions being adjustably tightened against I-beam 64 by tightening of bolt assemblies 100, 102. As in the previous embodiment, using this construction, container 22 can be drawn tightly against I-beam 64 by tightening of bolt assemblies 100, 102 such that opposed depending tabs 96, 92 and 98, 94 are drawn toward each other.

What is claimed is:

1. The fire extinguisher holder to be positioned against a support comprising:

an impact resistant cylindrical container open at each end for receiving a fire extinguisher loosely therein where said container has a length greater than its width and a construction similar to that of the fire extinguisher to be placed therein to provide protection for the fire extinguisher from impacts;

fire extinguisher within said container;

supporting means comprising a base integrally secured to one end of the cylindrical container for supporting the fire extinguisher within the cylindrical container and having triangular openings with the apex of the triangle directed radially inward;

said cylindrical container having an opening in the wall of said container extending vertically downward from the end without the support and is sufficiently wide for insertion of the hose of the fire extinguisher therethrough;

mounting means for non-fixedly releasably retaining the cylindrical container to the support comprising adjustable means for tightening the container against a fixed part without requiring the use of bolt holes, welds, or other changes to the support;

said means comprising a bracket secured to the container having a pair of outwardly extending tabs, one on each side of said opening in the wall and a pair of elongated rod means, each of which passes through one of said tabs and which may be adjustably tightened against said tab for holding the container against the support while directing said wall opening toward a recess in the support.

2. The fire extinguisher holder of claim 1 further comprising a second bracket secured to the container, having a pair of outwardly extending tabs, one on each side of said opening in the wall, with a second pair of elongated rod means passing through said tabs for cooperating with said first bracket and rod means to tighten the container against the suplport, said brackets being spaced apart one above the other on the container.

3. The fire extinguisher holder of claim 2 wherein each of said rod means has a hook which upon tightening of said rod means against said tabs acts to grasp the support.

4. The fire extinguisher holder of claim 1 wherein each of said rod means has a hook which upon tightening of said rod means against said tabs acts to grasp the support.

* * * * *